United States Patent [19]

Ferrantini

[11] 4,240,230

[45] Dec. 23, 1980

[54] THROW-AWAY ADAPTORS FOR GRINDING WHEELS

[75] Inventor: Salvatore Ferrantini, Buffalo, N.Y.

[73] Assignee: The Carborundum Company, Niagara Falls, N.Y.

[21] Appl. No.: 5,927

[22] Filed: Jan. 24, 1979

[51] Int. Cl.[3] ..... B24D 5/16; B24B 41/04

[52] U.S. Cl. ..... 51/168

[58] Field of Search ..... 51/168, 209 R, 376–379, 51/209 DL, 209 S

[56] References Cited

U.S. PATENT DOCUMENTS

| | | | |
|---|---|---|---|
| 3,136,100 | 6/1964 | Robertson, Jr. | 51/209 R |
| 3,210,892 | 10/1965 | Perham | 51/209 R |
| 3,500,592 | 3/1970 | Harrist | 51/376 |
| 3,800,483 | 4/1974 | Sherman | 51/376 |
| 4,015,371 | 4/1977 | Grayston | 51/168 |
| 4,138,804 | 2/1979 | Thielen | 51/168 |

*Primary Examiner*—Othell M. Simpson
*Assistant Examiner*—Roscoe V. Parker
*Attorney, Agent, or Firm*—David E. Dougherty; Raymond W. Green; Donald C. Studley

[57] ABSTRACT

An improved throw-away, or single use, adaptor particularly useful with depressed center grinding wheels is described. The adaptor comprises a hollow mandrel having an internal threaded portion for attaching the adaptor to the shaft of a grinding machine. The hollow mandrel has a saucer-shaped disc portion extending axially from the outer portion of the mandrel. The saucer-shaped disc portion has a concave surface and a convex surface. The concave portion is equipped with a plurality of internal rib members and has a flange around the periphery thereof to contact the side of a grinding wheel. The flange portion has a plurality of protrusions, or bosses, thereon adapted to be received in corresponding orifices in the grinding wheel. In operation, as the grinding wheel contacts a work piece, the torque, or stress, is directly imparted to the adaptor, as the adaptor is threadably attached to the shaft of the grinding wheel. The torque, in turn, is distributed in an equitable manner, through the combination of rib members and protrusions in the adaptor to the grinding wheel.

5 Claims, 2 Drawing Figures

THROW-AWAY ADAPTORS FOR GRINDING WHEELS

CROSS REFERENCE TO RELATED APPLICATION

Copending design patent application Serial No. 5,926, filed January 24, 1979 by Salvatore Ferrantini, discloses and claims an ornamental design for an adaptor for a grinding wheel, which can be used in conjunction with the present invention.

BACKGROUND OF THE INVENTION

The present invention relates to improved throw-away, or single use, adaptors particularly useful for depressed center grinding wheels. Depressed center grinding wheels are typically utilized in hand-held grinding machines. Such wheels have a concave portion surrounding the central opening on one face of the wheel and a corresponding convex portion surrounding the central opening on the opposite face of the wheel. The convex portion of the wheel typically receives an adaptor which provides a means of attaching the wheel to the shaft of a grinding machine. The adaptor extends through the wheel and is attached to the wheel within the concave portion of the wheel usually by peening, swaging or by a threaded attachment, leaving one entire side, or face, of the wheel available for grinding. A throw-away adaptor typically is attached to the grinding wheel by adhesive means on the convex portion of the wheel and by being swaged or rolled over against the opposite side of the wheel. Usually, grinding wheels utilized in hand-held machines range from about $\frac{1}{8}$ to about $\frac{3}{4}$ inches in thickness and from about 4 to about 18 inches in diameter. Although such wheels may be utilized in large permanently positioned machines, they are more particularly adapted to use in grinding machines which are hand held. Hand-held grinding machines are useful in deburring, smoothing, cleaning and polishing operations and generally operate at speeds in the neighborhood of 16,000 fpm, with corresponding rpm's, depending upon the wheel diameter.

Typically, grinding wheels are fabricated of an aglomerate of grit, or grain abrasive material, embedded in a formable matrix and frequently include a fiber material for added strength. Suitable grit materials include aluminum oxide, silicon carbide, tungsten carbide, diamonds and cubic boron nitride. Typical matrices are resins (resinoid) and rubber. The wheels are generally fabricated by compounding the mixture of grit and matrix material, forming the mixture and subsequently applying heat and pressure to permanently form the wheel. The wheels are fabricated with a central opening and are typically fitted with an adaptor to facilitate attachment of the wheel to the shaft of a grinding machine. Typically, a throw-away adaptor is fabricated of metal and consists of a hollow, cylindrical mandrel having a saucer-shaped disc portion axially extending therefrom. The hollow mandrel has an internally threaded portion within one end. The external surface of the mandrel surrounding the internal threaded portion has a plurality of flattened surfaces, or nut portion, to receive a wrench or tool to facilitate attachment of the threaded portion of the adaptor with the corresponding threaded portion of a grinding machine shaft. The saucer-shaped disc portion typically has a convex surface positioned toward the flattened tool-receiving surfaces and a concave portion to be positioned toward the wheel and adapted to receive the convex portion of a depressed center wheel. The concave portion has a flat flange surface along its upper periphery to provide contact with the side of the grinding wheel. Typically, a throw-away adaptor and a grinding wheel are assembled into an aligned composite unit, or assembly, by inserting the unthreaded portion of the mandrel through the central opening in the grinding wheel, adhesively attaching the adaptor and wheel along the concave portion of the adaptor and by swaging, or rolling over, the unthreaded portion against the opposite side of the wheel.

The adaptor provides a means of coupling the grinding wheel to the shaft of a grinding machine. Typically, the grinding wheel and adaptor as a unit are attached to the shaft by threadably engaging the internal threads of the adaptor with threads on the shaft. Although the prior art methods of attaching an adaptor to a grinding wheel have been generally satisfactory, improved grit and better heat resistance of the matrix material have made possible higher wheel speeds. As wheel speeds have increased, the torque, or turning effect, produced at the shaft, especially in intermittent grinding operations, has increased in direct proportion to wheel speed, placing greater stress on the adaptor.

The present throw-away adaptor provides means of distributing torque stress through the adaptor and around the periphery of the grinding wheel.

GENERAL DESCRIPTION OF THE INVENTION

The present adaptor comprises a hollow mandrel having an internal threaded portion within one end and a saucer-shaped disc portion extending axially from the outer portion of the mandrel. Preferably, the mandrel has outer flattened surfaces surrounding the internal threaded portion adapted to receive a tool such as a wrench to enable the adaptor to be threadably attached to the shaft of a grinding machine. The saucer-shaped disc portion has a convex portion facing the tool-receiving surfaces and a concave portion facing the unthreaded end of the mandrel. The concave portion has a flange, or contact surface, around the periphery adapted to contact the side of a grinding wheel. Preferably, the flange surface on the concave portion in on a plane 90° to the axis of the mandrel. The flange surface has a plurality of protrusions, or bosses, thereon. The protrusions are adapted to be received in corresponding orifices in a grinding wheel. The total number of protrusions is not critical; however, a minimum of three is highly desired in order to efficiently distribute the torque from the shaft motion to the grinding wheel. It is preferred that the protrusions be equally spaced along the periphery of the flange. The protrusions generally range from about 1/32 to about 1 inch, and, more preferably, from about 1/16 to about $\frac{1}{4}$ inch.

The concave portion of the disc contains a plurality of rib members extending radially from the mandrel to the flange portion. The rib members serve a two-fold purpose, that of lending support and stability to the disc, and that of distributing torque from the mandrel to the protrusions along the flange surface.

The adaptor may be fabricated of plastic, such as polypropylene, or pressed from a metal, such as steel, or, preferably, in the present case, cast from a metal, such as zinc.

In use, the unthreaded end of the adaptor is placed in the central opening of the grinding wheel. The wheel is provided with orifices corresponding to the shape and spacing of the protrusions in the flange surface of the adaptor. The protrusions are aligned with and inserted into the orifices in the wheel side, producing a unitized wheel aligned and secured on an adaptor ready to be threadably attached to the shaft of a grinding machine.

DETAILED DESCRIPTION OF THE INVENTION

The present invention will be described and explained in greater detail by reference to the attached drawings.

Figure 1:
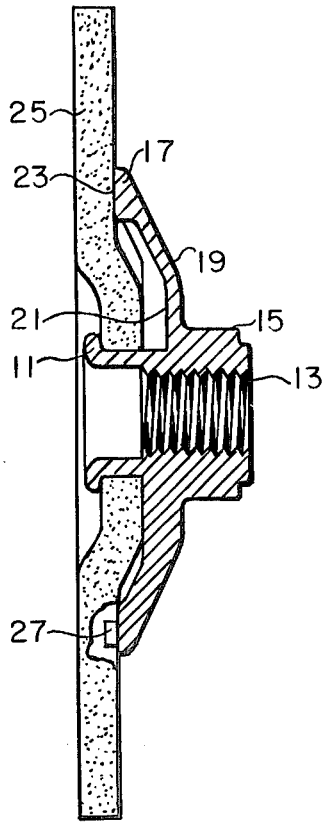
FIG. 1 is a central, vertical, longitudinal section of an adaptor of the present invention.

Looking now at FIG. 1 in detail, hollow mandrel 11 has an internal threaded portion 13 adapted to engage the shaft of a grinding machine and, preferably, has external tool-receiving surfaces, such as 15, adapted to facilitate threadably attaching the adaptor to the shaft of a grinding machine. Disc portion 17 extends axially from mandrel 11 and has a convex face 19 and a concave face 21. Concave face 21 has a flat flange portion 23 extending around the periphery thereof. Flange 23 and ribs 29 serve as contact surfaces for the side of a depressed center grinding wheel, such as 25. Grinding wheel 25 is shown in an engaged position. The present adaptor may easily be modified for use on a straight-sided grinding wheel by extending the rib members outward to provide contact with the straight side of the wheel. The contact surface of flange 23 is preferably on a plane 90° to the axis of mandrel 11 to facilitate alignment of the grinding wheel on a plane 90° to the axis of the shaft of a grinding machine. Flange 23 has a plurality of protrusions, or bosses, 27 extending therefrom. Protrusions 27 are adapted to be received in corresponding orifices in grinding wheel 25. While the total number of protrusions is not critical, a minimum of three is desired to efficiently and more equally distribute torque from the shaft of a grinding machine through the adaptor to the grinding wheel. Usually, from 3 to about 12 protrusions are useful, and generally from 3 to about 6 are practical. Less than 3 protrusions do not give a balanced torque distribution, and greater than about 12 protrusions does not yield an improvement in torque distribution that justifies the expense of forming excess protrusions and perforations in the grinding wheel to receive the protrusions. The protrusions are preferably equally spaced on flange 23. Although, as shown in the figures, the protrusions have a round cross-section, other configurations, for example, oval, square or triangular, may be employed, provided the sides of the portrusions adapted to enter the corresponding perforations or orifices in a grinding wheel are substantially straight and preferably on a plane 90° to the surface of flange 23. The length of the protrusions may vary from about 1/32 to about 1 inch. Usually, lengths less than about 1/32 to about b 1 inch. Usually, lengths less than about 1/32 inch do not give the positive grinding wheel contact that is desired, and lengths greater than about 1 inch may unnecessarily extend through the wheel, and the excessive length would not serve to improve the wheel attachment or the distribution of torque within the wheel. Protrusion lengths between about 1/16 and about ¼ inch are generally found to be eminently useful.

Figure 2:
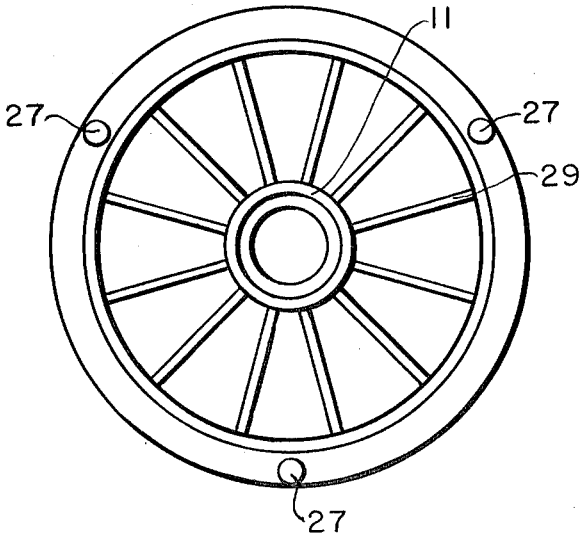
FIG. 2 is a side view of the adaptor of FIG. 1.

Looking now at FIG. 2, this figure is a side view of FIG. 1, showing the ribbed arrangement within concave surface 21 of disc 17. The rib arrangement, together with the protrusions 27 on flange 23 comprise a torque distribution system. Rib members 29 extend radially from mandrel 11 to flange 23. Although the number of ribs is not critical, it is highly desirable to have at least about eight in order to efficiently distribute torque. Usually, more than about 24 ribs does not improve the torque distribution and may add undesired mass which, when spinning on a shaft, merely adds to the torque stress when a force is applied to the grinding surface of an attached grinding wheel. Rib members 29 generally vary from about 1/16 to about ¼ inch in width and from about 1/32 inch to about ½ inch in height, depending upon the diameter and curvature of concave surface 21.

The present adaptor provides a means of positively coupling a grinding wheel to the shaft of a grinding machine. In operation, when the grinding wheel is turning at a high rpm and is contacted with a work piece, a large stress or torque is generated at the shaft of the grinding machine. The stress is directly imparted to the adaptor as the adaptor is threadably attached to the shaft. The stress, in turn, is distributed in an equitable manner, through the combination of rib members and protrusions, to the grinding wheel.

The foregoing description and embodiments are intended to illustrate the invention without limiting it thereby. It will be understood that various modifications can be made in the invention without departing from the spirit or scope thereof.

What is claimed is:

1. A unitary adaptor for distributing torque on grinding wheels comprising:

a. a hollow mandrel having an internal threaded portion in one end, b. a disc portion having a convex face and a concave face axially extending from said mandrel, c. said concave portion of said disc portion having a flange around the periphery thereof, d. a plurality of equally spaced protrusions extending from said flange, adapted to be received in corresponding orifices in a grinding wheel, and e. a plurality of rib members within said concave portion extending from said mandrel to said flange.

2. The adaptor of claim 1 wherein the external surface of said mandrel surrounding the internal threaded portion has a flat tool-receiving surface.

3. The adaptor of claim 1 wherein the protrusions range from about 1/16 to about 1 inch in length.

4. The adaptor of claim 1 wherein at least three protrusions extend from said flange.

5. The adaptor of claim 1 wherein said concave portion contains from about 8 to about 24 rib members.

* * * * *